US009598655B2

(12) United States Patent
Shaikh et al.

(10) Patent No.: US 9,598,655 B2
(45) Date of Patent: Mar. 21, 2017

(54) ADDUCTS OF LOW MOLECULAR WEIGHT PIB WITH LOW POLYDISPERSITY AND HIGH VINYLIDENE CONTENT

(71) Applicant: TPC Group LLC, Houston, TX (US)

(72) Inventors: Sohel K. Shaikh, Dhahran (SA); Jennifer Leigh Sengstock, Humble, TX (US)

(73) Assignee: TPC Group LLC, Houston, TX (US)

( * ) Notice: Subject to any disclaimer, the term of this patent is extended or adjusted under 35 U.S.C. 154(b) by 2 days.

(21) Appl. No.: 13/903,497

(22) Filed: May 28, 2013

(65) Prior Publication Data

US 2013/0324665 A1 Dec. 5, 2013

Related U.S. Application Data

(63) Continuation-in-part of application No. PCT/US2012/040897, filed on Jun. 5, 2012, and a (Continued)

(51) Int. Cl.
*C10L 1/232* (2006.01)
*C10M 149/02* (2006.01)
(Continued)

(52) U.S. Cl.
CPC ..... *C10L 1/232* (2013.01); *C10L 1/198* (2013.01); *C10L 1/2383* (2013.01); *C10M 129/91* (2013.01); *C10M 129/93* (2013.01); *C10M 133/54* (2013.01); *C10M 133/56* (2013.01); *C10M 145/02* (2013.01); *C10M 149/02* (2013.01); *C10M 151/04* (2013.01); *C10M 159/16* (2013.01); *C10M 2205/026* (2013.01); *C10M 2207/021* (2013.01); *C10M 2215/26* (2013.01); *C10M 2215/28* (2013.01); *C10M 2217/043* (2013.01); *C10M 2221/041* (2013.01); *C10N 2220/021* (2013.01)

(58) Field of Classification Search
CPC ..... C10M 149/02; C10M 145/16
USPC ..... 525/55
See application file for complete search history.

(56) References Cited

U.S. PATENT DOCUMENTS

RE26,330 E * 1/1968 Colfer ..... 208/48 R
4,829,130 A * 5/1989 Licchelli et al. ..... 525/384
(Continued)

FOREIGN PATENT DOCUMENTS

EP 145235 A * 11/1984 ..... C08F 10/00
WO WO 0125293 A1 * 4/2001

*Primary Examiner* — Mike M Dollinger
(74) *Attorney, Agent, or Firm* — Michael W. Ferrell

(57) ABSTRACT

A PIB derivative suitable for use as a fuel additive or lubricant additive prepared from a reactive low molecular weight polyisobutylene composition comprising at least 50 mol percent alpha vinylidene terminated polyisobutylene molecules, the composition having a polydispersity of no more than 1.5 and a number average molecular weight of at least 500 Daltons and no more than 1000 Daltons. The derivative is selected from the group consisting of: alkyl hydroxyaromatic compounds; alkyl alkoxy aromatic compounds; polyisobutenylsuccinic anhydrides; polyisobutenylsuccinimides; PIB-amine compounds; sulfurized PIB compounds; and Mannich condensation products of an alkylated hydroxyaromatic compound.

31 Claims, 7 Drawing Sheets

Related U.S. Application Data continuation-in-part of application No. 13/489,064, filed on Jun. 5, 2012, now Pat. No. 8,524,843.

(60) Provisional application No. 61/586,206, filed on Jan. 13, 2012, provisional application No. 61/520,328, filed on Jun. 8, 2011, provisional application No. 61/652,378, filed on May 29, 2012.

(51) Int. Cl.

| | |
|---|---|
| ***C10M 145/02*** | (2006.01) |
| ***C10M 133/54*** | (2006.01) |
| ***C10M 133/56*** | (2006.01) |
| ***C10M 151/04*** | (2006.01) |
| ***C10M 159/16*** | (2006.01) |
| ***C10L 1/198*** | (2006.01) |
| ***C10L 1/2383*** | (2006.01) |
| ***C10M 129/91*** | (2006.01) |
| ***C10M 129/93*** | (2006.01) |

(56) References Cited

U.S. PATENT DOCUMENTS

| | | | | |
|---|---|---|---|---|
| 4,849,572 | A * | 7/1989 | Chen et al. | 585/525 |
| 5,068,490 | A * | 11/1991 | Eaton | C08F 10/00 423/293 |
| 5,137,980 | A * | 8/1992 | DeGonia | C07C 51/567 508/239 |
| 5,330,667 | A * | 7/1994 | Tiffany et al. | 508/192 |
| 5,756,428 | A * | 5/1998 | Emert et al. | 508/192 |
| 5,883,196 | A * | 3/1999 | Rath et al. | 525/285 |
| 6,127,321 | A * | 10/2000 | Emert et al. | 508/192 |
| 6,562,913 | B1 * | 5/2003 | Baxter et al. | 526/64 |
| 8,016,898 | B1 * | 9/2011 | Lange et al. | 44/415 |
| 2002/0197497 | A1 * | 12/2002 | Gipson | 428/500 |
| 2003/0130140 | A1 * | 7/2003 | Harrison et al. | 508/192 |
| 2003/0145925 | A1 * | 8/2003 | Kingma et al. | 149/46 |
| 2003/0187173 | A1 * | 10/2003 | Kaszas | 526/339 |
| 2006/0094847 | A1 * | 5/2006 | Milner et al. | 526/335 |
| 2007/0100082 | A1 * | 5/2007 | Dickakian et al. | 525/333.7 |
| 2009/0298729 | A1 * | 12/2009 | Schober et al. | 508/287 |

* cited by examiner

ADDUCTS OF LOW MOLECULAR WEIGHT PIB WITH LOW POLYDISPERSITY AND HIGH VINYLIDENE CONTENT

CLAIM FOR PRIORITY

This non-provisional application claims the benefit of the filing date of U.S. Provisional Patent Application Ser. No. 61/652,378, of the same title, filed May 29, 2012. The priority of U.S. Provisional Patent Application Ser. No. 61/652,378 is hereby claimed and the disclosure thereof is incorporated into this application by reference. This application is also a continuation-in-part of U.S. patent application Ser. No. 13/489,064, and PCT Application PCT/US2012/040897 which applications claim priority to U.S. Provisional Patent Application Ser. Nos. 61/520,328 and 61/586,206. The priorities of U.S. patent application Ser. No. 13/489,064, PCT Application PCT/US2012/040897, U.S. Provisional Patent Application Ser. Nos. 61/520,328 and 61/586,206 are also claimed.

TECHNICAL FIELD

The present invention relates to derivatives of polyisobutylene (PIB) used as fuel and lubricant additives.

BACKGROUND

Derivatives or adducts of PIB useful as fuel and lubricant additives are known in the art. U.S. Pat. No. 7,091,285 to Baxter et al. discloses adducts of mid-range vinylidene PIB for use as additives in fuels and lubricants. The products are prepared with polyisobutylene having a vinylidene (alpha) content of less than 70% and where the polydispersity of the polyisobutylene is no more than 2. Polyisobutylene is reacted with maleic anhydride, a phenolic compound or another compound having a reactive site for subsequent amination.

U.S. Pat. No. 6,884,855 to Nelson et al. discloses sulfurized polyisobutylenes useful as lubricant additives, specifically wear and oxidation inhibitors. The materials are prepared by reaction of polyisobutene with a sulfur compound at elevated temperatures and low pressures.

U.S. Pat. No. 5,124,484 to Brown et al. discloses a process for producing polyisobutene amines by reacting carbonyl-functional PIB derivatives with amines followed by reduction with formic acid. Polyamines are among the recited reactants and the products are useful as fuel additives as noted above in connection with the Baxter et al. '285 patent.

U.S. Pat. No. 5,663,457 to Kolp teaches to prepare alkylated hydroxyl aromatics by reacting polyisobutylene with hydroxyaromatics in the presence of an acidic ion exchange resin. The products are likewise useful in or as lubricant and fuel additive compositions.

U.S. Pat. No. 5,725,612 to Malfer et al. discloses Mannich fuel additives prepared by reacting alkylated hydroxyaromatic compounds with an aliphatic polyamide and an aldehyde. Mannich reaction product fuel additives are also disclosed in United States Patent Application Publication No. US 2007/0068070 of Jackson et al. wherein the materials are prepared using a mixture of conventional and highly reactive polyisobutylene.

Lower molecular weight adducts for fuel or lubricant additives are desirable because of their higher activity on a weight or cost basis and preferred performance and viscosity characteristics in many instances. There is seen, for example, United States Patent Application Publication No. US 2012/0000118 to Lange et al. low molecular weight polyisobutyl-substituted amines as dispersant boosters. Such compounds may be prepared by hydroformylating polyisobutylene followed by reductive amination as is well known in the art. The polyisobutene precursors are noted in the publication as having a molecular weight in the range of 200 to 650 Daltons. See paragraph [0068].

Low molecular weight PIB, however, is notoriously difficult to produce, especially with both high vinylidene content and low polydispersity. See, for example, U.S. Pat. No. 5,068,490 to Eaton. Both of these properties are important for use as additives and additive presursors.

U.S. Pat. No. 5,326,921 to Chen discloses polybutenes with a molecular weight of about 600 and relatively narrow molecular weight distributions. The materials are made with aluminum chloride catalyst at a temperature of 50° C. and residence times of 30 minutes. See Table I at Cols. 13-14. At these times and temperatures the alpha and beta content of the product is conventional as seen in the commercial material discussed hereinafter. Moreover, the material is not chloride-free which is also a desirable characteristic for additives, especially because of potential corrosion caused by high chloride levels.

SUMMARY OF INVENTION

In one embodiment, there is provided PIB adducts useful as fuel and lubricant additives derived from a reactive low molecular weight polyisobutylene composition comprising at least 50 mol percent alpha vinylidene terminated polyisobutylene molecules, the composition having a polydispersity of no more than 1.5 and a number average molecular weight of at least 500 Daltons and no more than 1000 Daltons. Such adducts include alkyl hydroxyaromatic compounds:

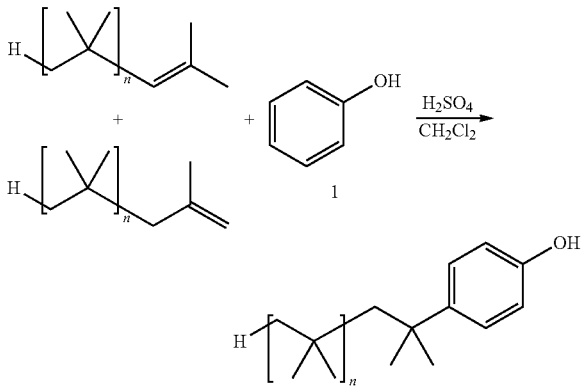

as well as PIB-maleic anhydride reaction products such as polyisobutenylsuccinic anhydrides (PIBSAs) and polyisobutenylsuccinimides (PIBSIs):

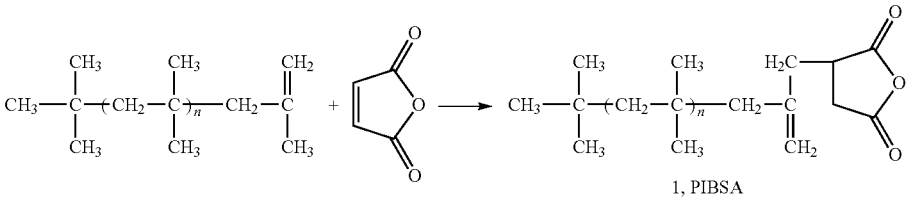

-continued

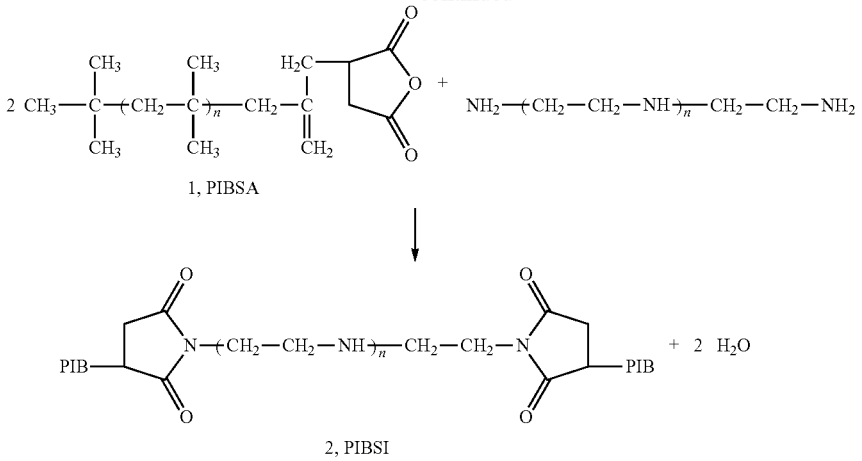

Other useful PIB derivatives include amines, sulfurized PIB adducts, and Mannich condensation products prepared with alkylated phenols or other hydroxyaromatic compounds.

A preferred process for making the adducts of the invention includes: (a) providing a feedstock comprising isobutylene; (b) providing a catalyst composition comprising a Friedel-Crafts catalyst and a complexing agent therefor; (c) providing a suitable chain transfer agent ("CTA"); (d) providing a polymerization-retarding agent; (e) introducing said feedstock, said catalyst composition, said chain transfer agent and said polymerization-retarding agent into a reaction zone to form a reaction mixture; (f) intimately intermixing the reaction mixture in said reaction zone; (g) optionally adding a modifier; (h) maintaining the reaction mixture in its intimately intermixed condition to thereby cause the isobutylene therein to undergo polymerization to form polyisobutylene; (i) withdrawing a product stream comprising low molecular weight, highly reactive polyisobutylene from said reaction zone and (j) derivatizing the polyisobutylene to form an adduct of the invention.

Further aspects and advantages of the invention will become apparent from the discussion which follows.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The present invention is described in connection with the attached Figures, wherein.

DETAILED DESCRIPTION

Figure 1:
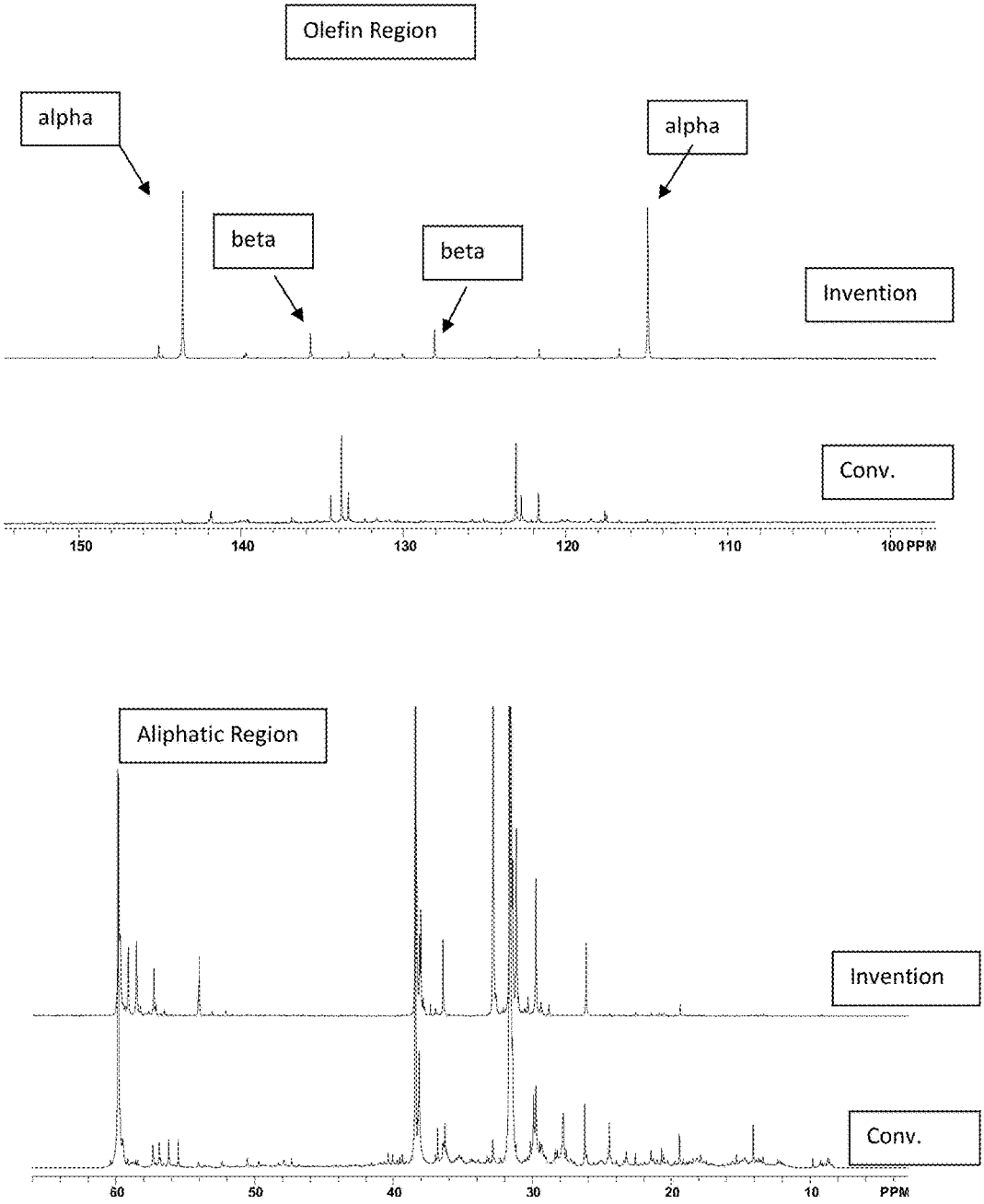
FIG. 1 is a comparison of $^{13}C$ NMR spectra of low molecular weight PIB used in the inventive products with conventional low molecular weight PIB.

The invention is described in detail below with reference to several embodiments and numerous examples. Such discussion is for purposes of illustration only. Modifications to examples within the spirit and scope of the present invention, set forth in the appended claims, will be readily apparent to one of skill in the art. Terminology used throughout the specification and claims herein is given its ordinary meaning as supplemented by the discussion immediately below, for example, "conversion", "selectivity" and yield are related by the mathematical definition X(conversion)*S (selectivity)=Y(yield), all calculated on a molar basis; e.g. in a certain reaction, 90% of substance A is converted (consumed), but only 80% of it is converted to the desired substance B and 20% to undesired by-products, so conversion of A is 90%, selectivity for B 80% and yield of substance B is 72% (=90%*80%)

Unless otherwise indicated, "percent", "%" or like terminology refers to mole percent of a component.

Unless otherwise specified, molecular weight herein is reported as number average molecular weight, in Daltons, and is measured by gel permeation chromatography (GPC). GPC measurements may be carried out using a Viscotek GPCmax® instrument (Malvern instruments, Worcestershire, UK) employing a 3-column set-up (5 μm (particle size) 100 Angstrom (pore size), 5 μm 500 Angstrom, 5 μm $10^4$ Angstrom) and a Refractive Index (RI) detector. Polyisobutylene standards are used to construct the calibration curve using this technique.

Polydispersity or PDI is defined as the ratio of the weight average molecular weight divided by the number average molecular weight of the polymer.

Structures of Double Bonds in Olefinic Polyisobutylenes

The following major end groups have been commonly identified in PIB structures having mid-range and high vinylidene content PIB. See, for example, W. Gunther et al,

*Die Angewandte Makromoleculare Chemie*, Vol. 234 (1996), pages 71-90; and J. Spevacek et al, *Polymer Bulletin*, Vol. 34 (1995), pages 461-467.

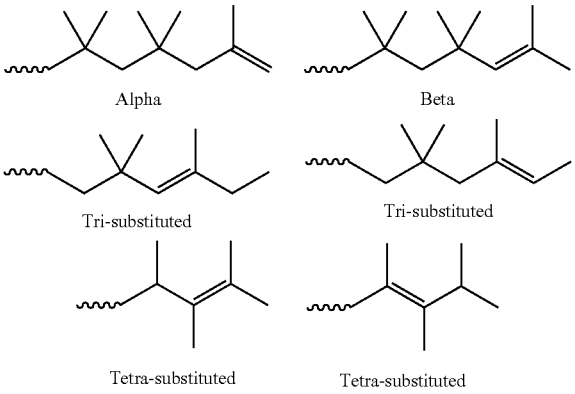

Additional structures are illustrated in Table 1 below. When calculating endgroup percentages, all PIB molecules found in the PIB compositions having a significant presence (more than half a percent or so) are included in endgroup calculations. The end group content is determined by nuclear magnetic resonance $^{13}C$ NMR as is well known in the art.

Polyisobutylene, "PIB" and like terminology refers to polymers made up of repeat units derived from isobutene, also referred to as isobutylene.

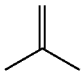

Such polymers are derived from feedstocks made up of purified isobutenes and hydrocarbon diluents, from isobutene concentrate, dehydro effluent, or from raffinate streams. The PIB polymer consists essentially of repeat units derived from isobutylene, but may contain minor amounts of material derived from 1-butenes, butadiene or other $C_4$ olefins, 2-butenes (cis and/or trans) depending on the feedstock composition. Typically, the polymer is more than 99% by weight derived from isobutylene monomer. One of skill in the art will appreciate that the feedstock may need to be purified to remove water and oxygenates such as alcohols, ethers and so forth to avoid adverse effects on the catalyst. Typical media for removal of impurities from hydrocarbon feed streams use molecular sieves, activated alumina and other hybrid adsorbents. A suitable absorbent to reduce water and oxygenate levels to desired limits is UOP AZ 300 (Des Plaines, Ill., USA). Post treatment, prior to feeding to the reactor, the feed stream preferably has less than 3 ppm of oxygenates and less than 1 ppm of water.

Preferred PIB compositions include those wherein a first portion of the PIB molecules have alpha position double bonds and a second portion of the molecules have beta position double bonds wherein said first and second portions together include at least 70 mole % of the PIB molecules of the composition and wherein no more than 10 mole % of the PIB molecules of the composition have tetra-substituted double bonds. Compositions wherein the first and second compositions comprise 80 or 90 mole % of the molecules are especially preferred. The first and second portions together typically includes at least 85 mole % of the PIB molecules of the composition and most preferably the said first and second portions together include at least 90 mole % of the PIB molecules of the compositions. In some cases the first portion includes less than 72.5 mole % of the PIB molecules of the composition and sometimes less than 70 mole % of the PIB molecules of the composition. In preferred cases, no more than 5 mole % of the PIB molecules of the composition have tetra-substituted double bonds.

Applicant found that the use of a CTA surprisingly facilitates the production of low molecular weight, highly reactive PIB in the polymerization reaction and that a polymerization-retarding agent used with the chain transfer agent greatly reduces polydispersity, leading to much better molecular uniformity.

Suitable CTAs are known in literature. For example, J. P. Kennedy et al, *Carbocationic Polymerization* (1982), page 229, John Wiley & Sons, New York, list several chain transfer agents and their transfer coefficients. Particularly suitable CTAs for the present reaction are selected from the group consisting of 2,4,4-Trimethyl-1-pentene ("α-DIB"), 2.4.4.-Trimethyl-2-pentene ("β-DIB"), 2-ethyl-1-hexene, 2-methyl-1-pentene and mixtures thereof. Of these, α-DIB, β-DIB, or mixtures thereof are preferred. The structures of α-DIB and β-DIB are shown below:

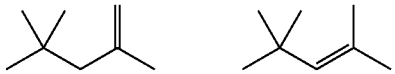

2,4,4-trimethylpent-1-ene (α-DIB) 2,4,4-trimethylpent-2-ene (β-DIB)

Other suitable CTAs may include 2-octene; 2,5-dimethyl-2,4-hexadiene; cyclohexadiene; isoprene; piperylene and vinylcyclohexane. In general, the chain transfer agent in an olefinic molecule with a molecular weight higher than isobutene and lower than the low molecular weight polymer product produced in accordance with the invention. The CTA is readily detectable by GPC in the product composition by GPC.

Polymerization can advantageously be performed using conventional equipment such as, for example, a loop reactor. Such equipments are already used in conventional processes for the production of polyisobutylene. Thus, the present invention can be practiced with practically no change in the equipment used.

The optional use of a suitable modifier for the CTA sometimes helps in keeping the molecular weight of the PIB produced low. The purpose of the modifier is believed to assist in controlling the vinylidene content of the PIB product. The catalyst modifier may be any compound containing a lone pair of electrons such as, for example, an alcohol, ester, amine and the like. Suitable modifiers in the present invention are alcohols, preferably a C1-C8 primary alcohol, more preferably methanol.

Without intending to be bound by any particular theory, it has been well known that normucleophilic strong bases such as hindered pyridine compounds called 'proton traps' are used in carbocationic polymerization systems to eliminate initiation by protic impurities. Electron donor (ED) compounds such as dimethyl acetamide (DMA), dimethysulfoxide (DMSO) or pyridines are also added to reduce the iconicity (positive charge) of the active species and thus eliminate or reduce side reactions such as transfer to monomer. Thus these greatly reduce polydispersity in cationic polymerization systems and are often used to synthesize living polymers with very narrow polydispersities and well defined structures. However, these usually also result in greatly reduced rates of polymerization. EDs are also known to form complexes with the active species and these can precipitate out of the polymerization system resulting in undesirable impurities. Provided that the polymerization-retarding agent is carefully selected and/or controlled via appropriate concentration levels, the products of the invention are produced as described herein.

Desired particularly in continuous polymerization systems will be mildly basic compounds which could be used as controlled polymerization rate retarders which benefit polydispersity but at the same time do not precipitate out of the polymerization system or greatly effect reaction rate. Retarding agents could be effectively used especially when the goal is to make low molecular weight polymers.

*Electron Pair Donors in Carbocationic Polymerization*, Kaszas et al., Polymer Bulletin 20, pp. 413-419 (1988); and U.S. Pat. No. 6,852,808, issued Feb. 8, 2005, entitled "Method for Producing Homopolymers and Copolymers of Isobutene", to Hüffer; the entire disclosures of which are incorporated herein by reference disclose compounds which are optionally used in connection with the present invention. Suitable polymerization electron donors, retarding and chain transfer agents for use with the invention are also described in Kennedy, J. P. and Ivan, B., DESIGNED POLYMERS BY CARBOCATIONIC MACROMOLECULAR ENGINEERING: THEORY AND PRACTICE, Hanser (1991), pp. 86-90 and 136-137, the disclosure of which is also incorporated herein by reference.

Polymerization retarding agents are used together with chain transfer agents to produce products of low polydispersity (polydispersity or PDI is the ratio of the weight average molecular weight divided by the number average molecular weight of the polymer). Suitable polymerization-retarding agents are compounds that have mild basicity, especially phenolic compound and hindered phenols where the retarding effect can be controlled either by the type of phenol molecule selected or its concentration in the polymerization system. (*Rates of Initiation of the Cationic Polymerization of Isobutene*, Russel et al., J. Polymer Science, Symposium No. 56, pp. 183-189 (1976);) For example, various hindered phenolic structures could be used as mild rate retarders, strong rate retarders or copolymers depending on the functionality of the phenyl ring. Some preferred polymerization-retarding agents include:

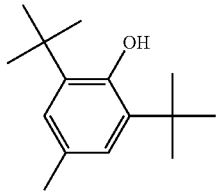

2,6-bis(1,1-dimethylethyl)-4-methylphenol (BHT)

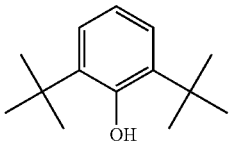

2,6-di-tert-butylphenol or, if a polymerizable compound is preferred, a vinyl functional hindered phenol may be used such as:

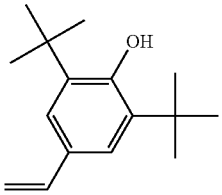

2,6-di-tert-butyl-4-vinylphenol

Hindered phenol polymerization-retarding agents remain in the composition, whether or not copolymerized into the polymer backbone and are operative as antioxidants such that they stabilize the polymer in use. See *Functional Polymers, XLIII. Olefin Copolymers of* 2,6-*Di-t-butyl*-4-*vinyl* (*or* 4-*isopropenyl*) *phenol*, Paul Grosso and Otto Vogl, J. Macromol. Sci.-Chem., A23(11), pp. 1299-1313 (1986) as well as U.S. Pat. No. 4,097,464, issued Jun. 27, 1978, entitled 2,6-Di-Tert-Alkyl-4-Vinylphenols as Polymerizable Antioxidants", to Kline and U.S. Pat. No. 5,157,164, issued Oct. 20, 1992, entitled "Polymerizable Antioxidant Composition", to Olivier. Ethyl benzoate and other compounds may also be employed as polymerization-retarding agents to control polydispersity, such as the compounds disclosed in the following reference: *Cationic Polymerization of Isobutylene Coinitiated by AlCl3 in the Presence of Ethyl Benzoate*, Li et al., Chinese Journal of Polymer Science, Vol. 28, No. 1 (2010), pp 55-62.

Applicant found that the present process produces PIB with molecular weights in the desired low ranges and with alpha-vinylidene content exceeding 75, sometimes exceeding 80%. The PIB has viscosities in low ranges (e.g., between 2-80 cps at 100° F.), with flash temperatures as measured by the Pensky-Martens Closed Cup test (PMCC) in the range 100-180° F. The flash temperatures as measured by the Cleveland Open Cup test (COC) were in the range 80-150° F. Details relating to the operation of a loop reactor and its operation useful for making the composition of the invention are provided in European Patent No. 1 242 464, as well as WO 2012/170411 the disclosures of which are incorporated by reference.

Example 1

Production was conducted in a loop reactor wherein Isobutylene 99.95%, DIB with butylated hydroxytoluene (BHT) present at a concentration of 75 ppm in the DIB and the BF3 methanol catalyst complex were added to the reactor loop. The flow of monomer was maintained at a constant rate. Reaction was carried out at temperatures between 80 and 95 F. The pressure in the reactor loop was maintained at @ less than 200 psi. Modifier (methanol) flow was maintained at a certain ratio to the initiating species. Molecular weight measurements were made by size exclusion chromatography (SEC) using PIB standards. BHT was calibrated using a GC-MS instrument. A PIB product in the 600 Mn range was produced.

The material of Example 1 was analyzed by $^{13}$C NMR and compared with a commercially available, conventionally prepared low molecular weight PIB having a number average molecular weight, Mn, of 700 and a polydispersity of 1.85. Results appear in FIG. 1 and in Table 1, below, wherein it s seen the conventional low molecular weight PIB has only about 1% alpha molecule content, relatively low content of beta molecules and large amounts of trisubdstituted and tetrasubstitued molecules. It is also seen in FIG. 1 that the conventional material has relatively numerous species present in both the olefinic and aliphatic spectral regions.

TABLE 1

End Group Analysis of polyisobutylene as synthesized according to reaction conditions in Table 1 compared with conventional low molecular weight PIB

| Endgroup type | Structure | INV. (%) | INV. Range (%) | Conv. (%) | Conv. Range (%) |
|---|---|---|---|---|---|
| Alpha | | 65.85 | 60-90 | 1.05 | 0-10 |
| Beta | | 10.81 | 30-10 | 0.00 | 0-10 |
| Isopropyl | | 1.65 | 0 | 0.00 | 0 |
| Ethyl branch | | 4.65 | 0 | 0.00 | 0 |
| Tetrasubstituted | | 2.91 | 1-3 | 15.95 | 10-20 |
| Trisubstituted | | 2.40 | 2-5 | 2.42 | 1-5 |
| Trisubstituted | | 0.71 | 1-2 | 50.87 | 45-60 |
| substituted alpha | | 6.69 | 1-7 | 8.40 | 5-10 |
| Other olefins | | 4.32 | 1-5 | 21.30 | 1-5 |

Example 2

Two gms of phenol dissolved in 10 ml of methylene chloride are added to a reaction vessel (3 necked flask). To it, was added 20 mL of polysiobutylene stock solution (containing the low molecular weight PIB of Example 1) in methylene chloride (concentration 0.25 gms/mL). 1.86 mmol of $BF_3$-methanol catalyst solution was then added dropwise to the reaction vessel, gradually such that the reaction temperature did not rise. The reaction vessel was then closed and the reaction was conducted in a nitrogen atmosphere. After 300 minutes, the reaction was quenched with a few drops of triethyl amine (till a color change was observed). Hexane (100 ml) was added to the reaction vessel and the reaction mixture was poured into a separation funnel. An equal volume of acetonitrile (MeCN) was added to the separation funnel. The reaction contents were washed 3 to 4 times to remove excess phenol. The hexane phase was subsequently washed with an equal volume of water with 5 mL of 1M hydrochloric acid and then twice with DI water. The organic phase was then dried with magnesium sulfate, filtered and rotavaped at 80° C. under reduced pressure to give the desired product.

Example 3

The same procedure as in Example 1 was followed with the exception that the polymer stock solution was now made with the conventional low molecular weight PIB described above.

Figure 2A:
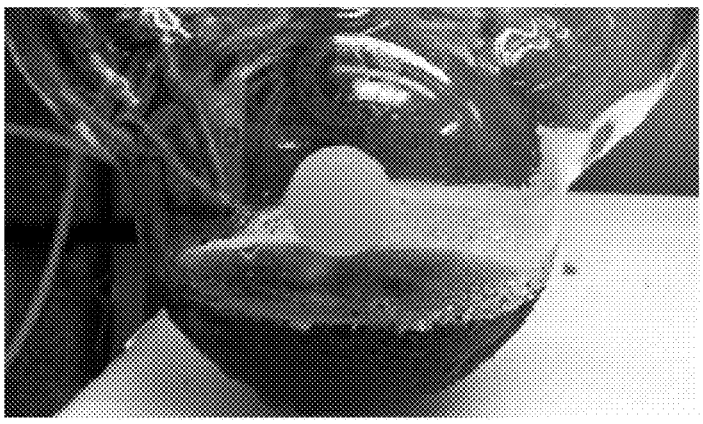
FIG. 2A and FIG. 2B are photographs of an alkyl phenol reaction product of conventional low molecular weight PIB and an alkylphenol reaction product of low molecular weight PIB of the invention.
Figure 2B:
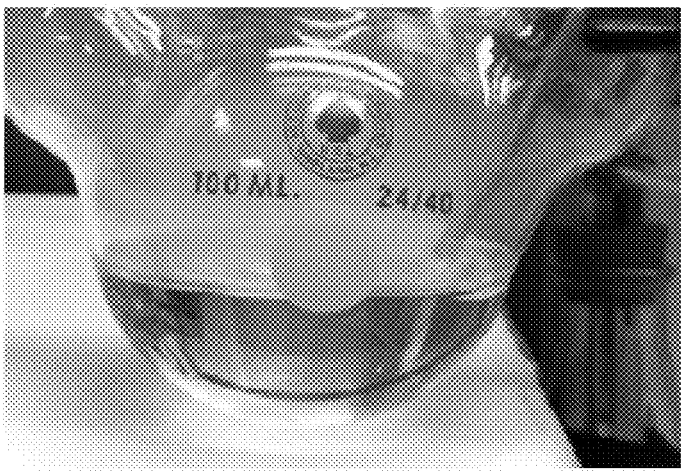

FIG. 2A is a photograph, before work-up of the material of Example 3 wherein it is seen that the crude product had a deep red color. On the other hand, the product of Example 2 of the invention produced a relatively clear product as is seen in FIG. 2B. Without intending to be bound by theory, it is believed that the numerous impurities in the conventional material seen in FIG. 1 are believed to produce color bodies upon reaction which have adverse effects on appearance. The color is difficult to remove and persists even after work-up as described in Example 2.

Figure 3A:
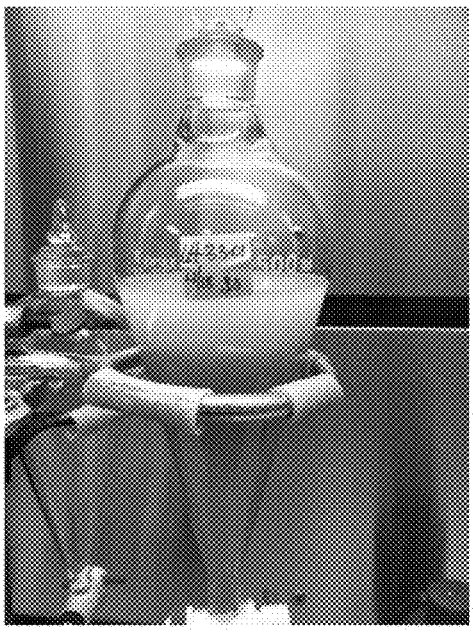
FIGS. 3A and 3B are photographs of a first wash/separation of alkylation products.
Figure 3B:
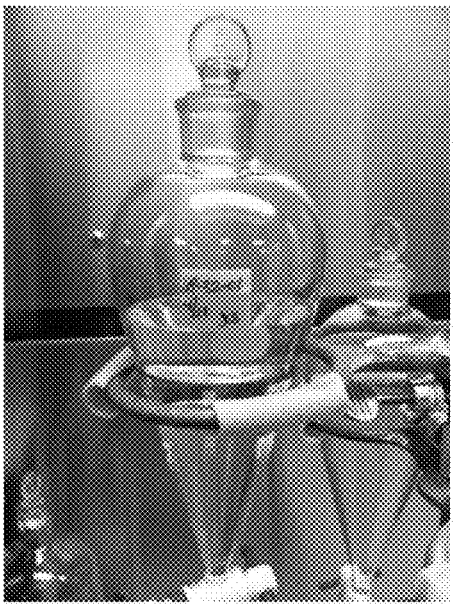
Figure 4:
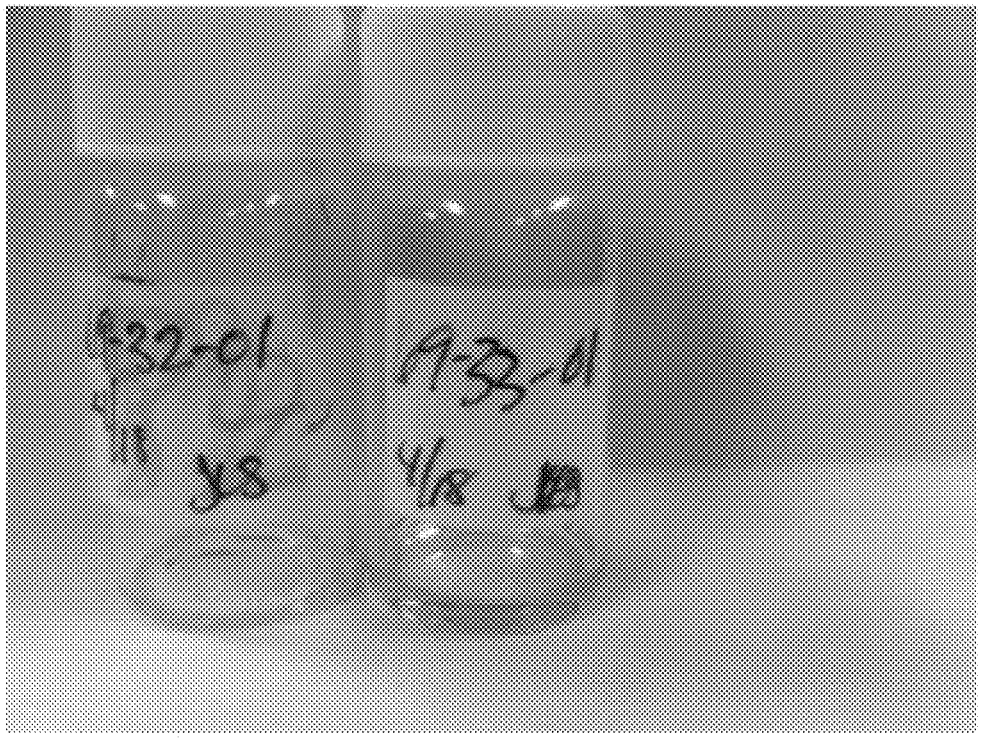
FIG. 4 is a photograph showing alkylation products after work-up.

In this regard, there is shown in FIG. 3A a photograph of the first wash/separation of Example 3, wherein it is seen the crude product washed with acetonitrile (upper phase in the photograph) has persistent color. FIG. 3B is a photograph of the invention crude product (Example 2) first ACN wash wherein the product (upper phase) is clear. Likewise, even after further work-up, the color persists in the alkylated product made with conventional PIB as seen in FIG. 4. FIG. 4 is a side-by-side photograph of the worked-up product of the invention (left side, Example 2) and an alkylated product made with conventional PIB (right side, Example 3).

Example 4

The same procedure as in Example 2 was followed with the invention material, except that the amount of the catalyst employed (BF3-methanol) was increased to 3.29 mmol.

Example 5

The same procedure as in Example 3 was followed with conventional material, except that the amount of the catalyst employed (BF3-methanol) was increased to 3.29 mmol.

Example 6

The same procedure as in Example 2 was followed with the invention material, except that ortho cresol was used as the hydroxyl aromatic reactant.

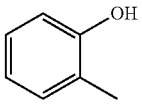

ortho cresol

Example 7

The same procedure as in Example 3 was followed with conventional material, except that ortho cresol was used as the hydroxy aromatic reactant.

Results appear in Table 2 below as well as in FIGS. 5-10.

TABLE 2

Alkylation Results

| Ex | Polymer | Alkylate | Catalyst (mmol) | % Residual Alkene | % para substituted product | Description |
|---|---|---|---|---|---|---|
| 2 | Ex. 1 | Phenol | 1.86 | <5 | 89 | Clear |
| 3 | Conv. | Phenol | 1.86 | 67 | 60 | Yellowish |
| 4 | Ex. 1 | Phenol | 3.29 | <5 | 91 | Clear |
| 5 | Conv. | Phenol | 3.29 | 40 | 65 | Yellowish |
| 6 | Ex. 1 | o-Cresol | 1.86 | 9 | 99 | Clear |
| 7 | Conv. | o-Cresol | 1.86 | >60 | 45 | Yellowish |

FIGS. 5-10 are $^1$H NMR spectra of the alkylphenol products of Examples 2-7 wherein the alkylate products appear at 6.3-6.8 ppm and residual alkene appears at from 4-6 ppm, centered at about 5.2 ppm or so.

Figure 5:
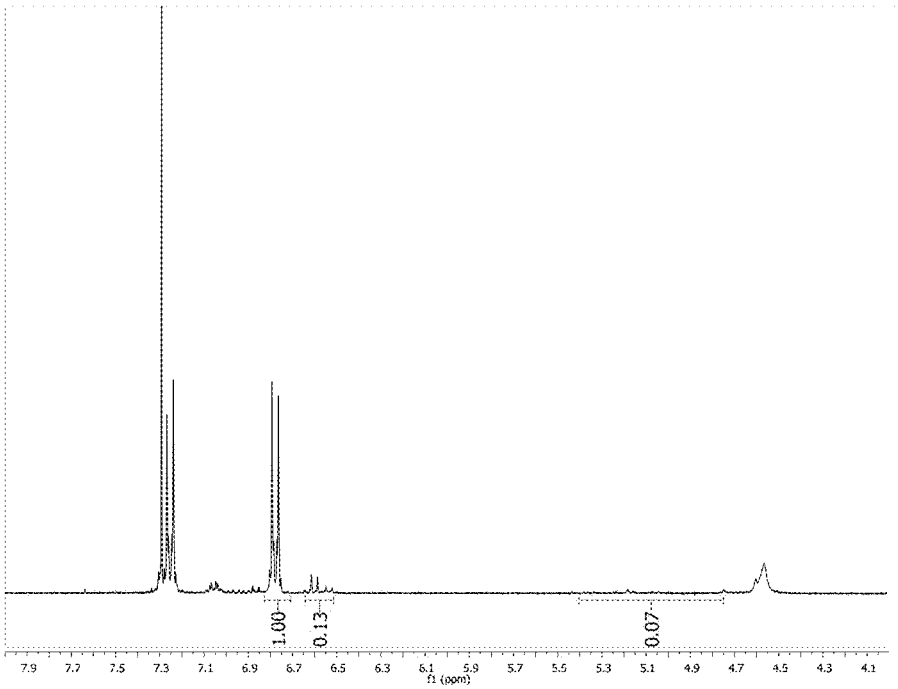
FIG. 5 is an $^{1}H$ NMR spectrum of an alkyl phenol reaction product of the invention.

FIG. 5, the spectrum from Example 2 of the invention PIB alkylate, indicates almost no alkene left since the region from 4.5-5.5 is a flat line; The percent of desired para-substituted product count (~90%) is based on the integration value of the PIB-phenol spectra in the 6.7 to 6.85 range; byproduct integration region: 6.50-6.65 ppm. It is seen in FIG. 5 that the % of residual alkene <5%; and the % of para-substituted PIB-phenol=89%.

Figure 6:
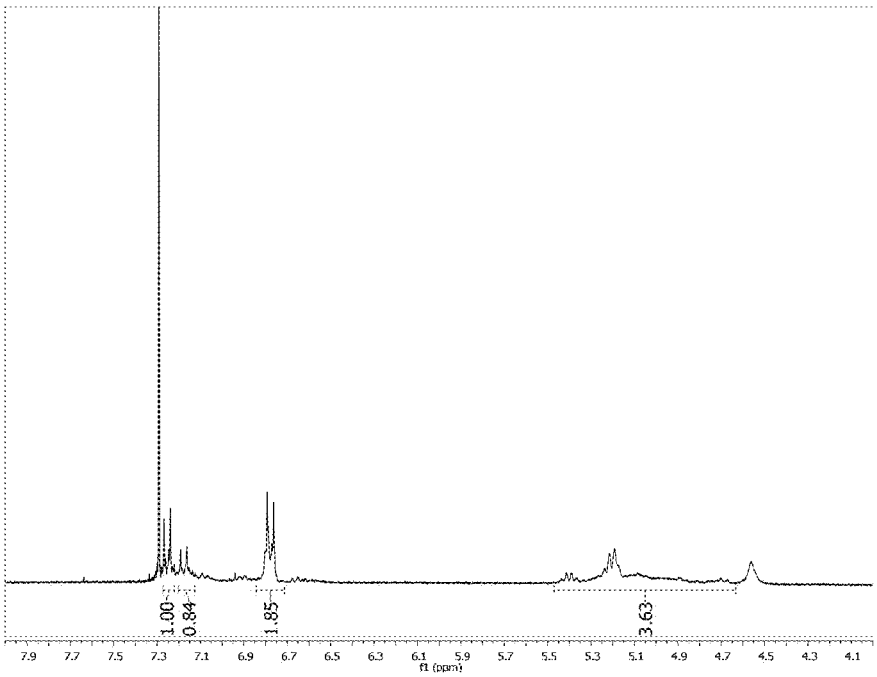
FIG. 6 is an $^{1}H$ NMR spectrum of an alkyl phenol prepared with conventional PIB.

FIG. 6, the spectrum from Example 3 of the conventional PIB alkylate, shows that the conventional PIB did not exhibit good conversion due to large amount of alkene protons as indicated in the spectrum; the conversion of double bonds is less than 40% (assuming alkene protons remaining in the product are from tri-substituted double bonds). Desired product integration region: 7.20-7.28 ppm, byproduct inegration region: 7.08-7.20 ppm. The peak at 6.7-6.8 ppm region is several peaks overlay and can be used as sum of total products. In this product, the desired para-substituted product only account for 60% of all converted alkenes, that is, % of residual alkene @67%; % of para-substituted PIB-phenol=60%.

Figure 7:
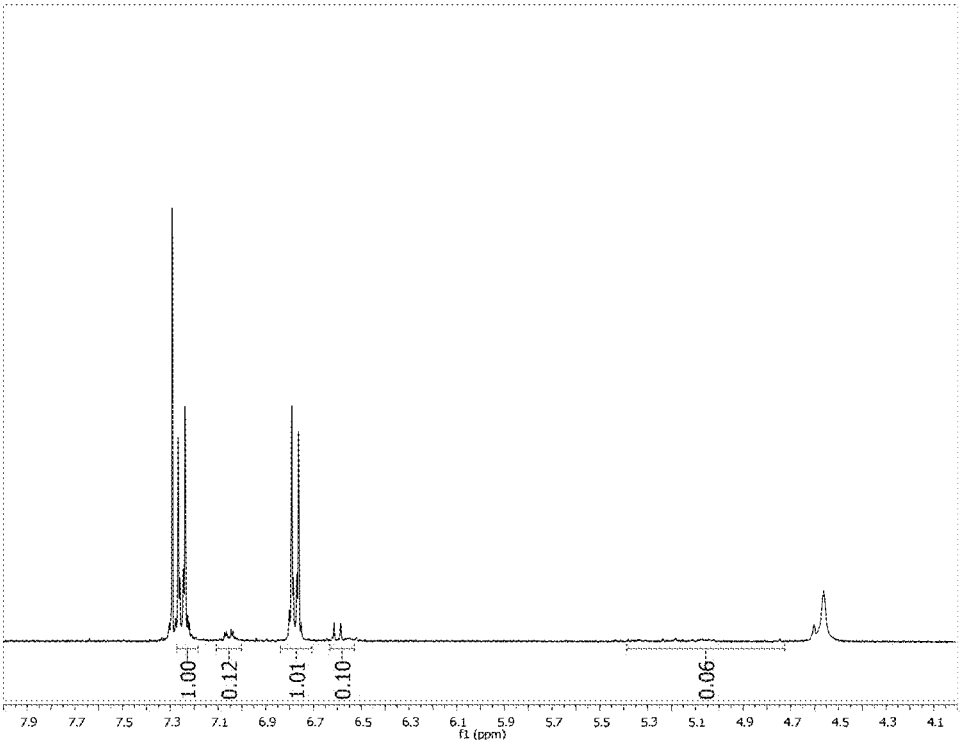
FIG. 7 is an $^{1}H$ NMR spectrum of another alkyl phenol reaction product of the invention.

FIG. 7, the spectrum from Example 4 of the invention PIB alkylate, shows results similar to Example 2, the higher catalyst concentration resulted in a slightly higher conversion of the alkene double bonds. Desired product integration range: 6.70-6.85 ppm, by product integration region: 6.50-6.65 ppm; Another set of integration value can be obtained by comparing value of 7.15-7.28 ppm (desired product), and by product (6.95-7.10 ppm). The two set of values agrees fairly well: % of residual alkene <5%; % of para-substituted PIB-phenol=91%

Figure 8:
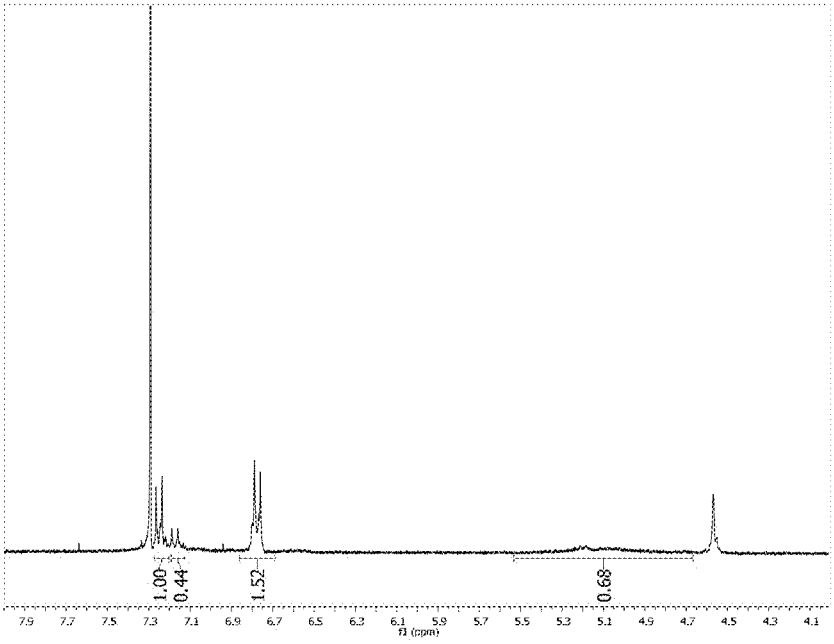
FIG. 8 is an $^{1}H$ NMR spectrum of another alkyl phenol prepared with conventional PIB.

FIG. 8 is the resulting spectrum of reaction of conventional PIB and phenol with a higher concentration of catalyst, Example 5. It can be seen that higher catalyst concentration did reduce the alkene content, so conversion is @60% of alkenes. Desired product integration region: 7.20-7.28 ppm, by product inegration region: 7.08-7.20 ppm, The peak at 6.7-6.8 ppm region is several peaks overlay and can be used as sum of total products. The ratio of para-substituted product in the product mixture is @65%. The conversion and yield numbers have improved but still do not compare to yields seen with the invention. The product also looks more discolored (pale yellow). Results: % of residual alkene 40%; % of para-substituted PIB-phenol=65%

Figure 9:
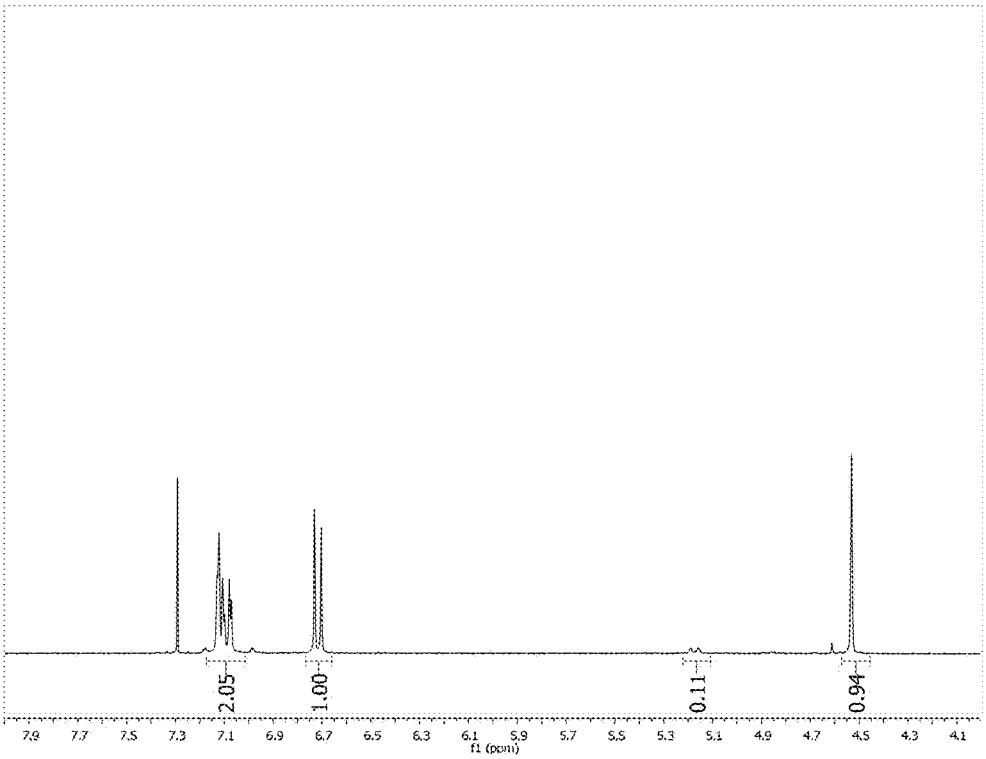
FIG. 9 is an $^{1}H$ NMR spectrum of alkylated o-cresol prepared in accordance with the invention.

FIG. 9, the spectrum from Example 6 of the invention PIB alkylate, shows the invention material reacts very well with o-cresol, with about 10% alkene left and an almost quantitative yield of the desired product. Desired product integration region: 6.60-6.75 ppm (1H), 7.00-7.15 ppm (2H). Residual alkene level is @9% with almost all product converting to para-substituted cresol: % of residual alkene 9%; % of para-substituted PIB-cresol 99.5%

Figure 10:
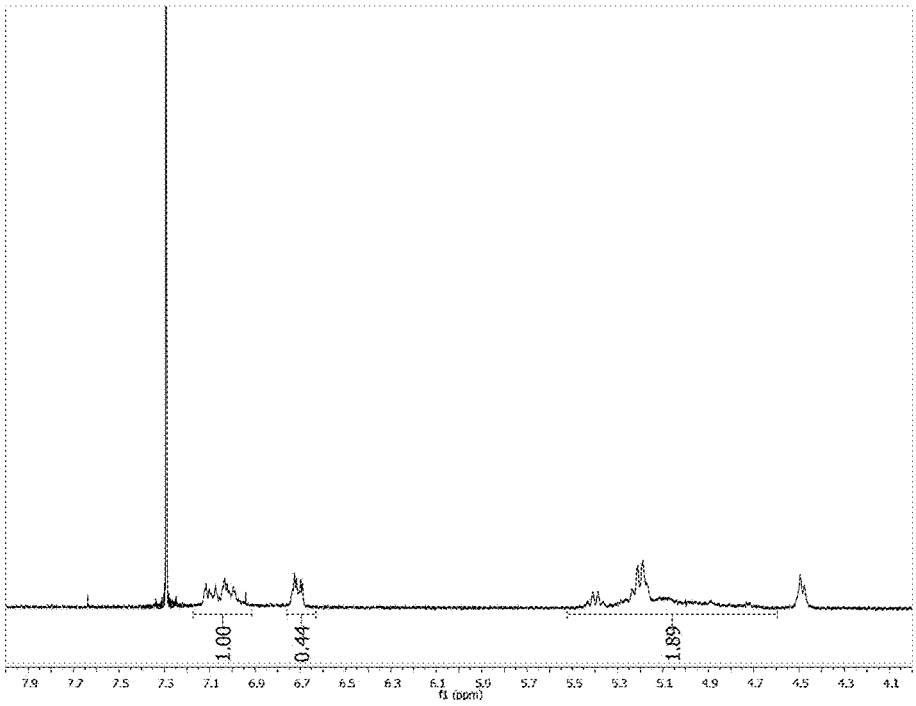
FIG. 10 is an $^{1}H$ NMR spectrum of alkylated o-cresol prepared with conventional PIB.

FIG. 10 is the spectrum of Example 7 (conventional PIB, o-cresol) and it does not look as neat as the invention product of Example 6. Conversion is still very low with only about 35% of alkene converting to product. In the product mixture it is difficult to tell how much of the para-substituted product exists due to peak overlapping. An estimation was done based on the enlarged aromatic region integration values. A further enlarged aromatic region and split integration region indicate Desired product: 7.05-7.15, 45% other byproduct 6.95-7.05 ppm 55%. The 6.65-6.75 ppm signal is likely an over lap of peaks from both desired product and by product.

It is seen in the above data that the low molecular weight PIB adducts of the invention are more easily produced in higher yield and of better quality than adducts prepared with conventional low molecular weight PIB.

Additional Embodiments

One of skill in the art will appreciate that instead of phenol, alkylated hydroxyaromatics may be prepared from other hydroxyaromatics such as:

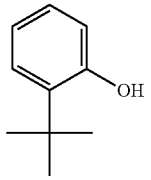

2-tert-butyl phenol or one may employ an alkoxyaromatic precursor to make alkylalkoxyaromatics. A suitable precursor is anisole, having the structure:

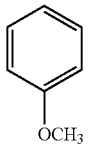

anisole

Alkylated hydroxyaromatics and alkoxyaromatics are useful in fuel and lubricant compositions. Alkylated hydroxyaromatics are particularly useful for making Mannich detergent additives as discussed hereinafter.

The low molecular weight PIBs with low polydispersity are likewise preferred for making PIBSA and PIBSI as noted above. Exemplary PIBSA and PIBSI compounds are enumerated in *Polyfunctional PIB Succinimide Type Engine Oil Additives*, L. Bartha et al., *Lubrication Science*, August, 2001, pp. 313-328, the disclosure of which is incorporated herein by reference. Such compounds are derivatives within the scope of the present invention when prepared with low molecular weight PIB with low polydispersity as recited in the annexed claims.

Other useful derivatives within the scope of the present invention are amines which may be prepared by reaction of an amine with a PIBSA compound or may be prepared from another carbonyl functionalized PIB as described in U.S. Pat. No. 5,124,484, Col. 2, lines 38-60, the disclosure of which is also incorporated by reference.

The low molecular weight PIB used in connection with the invention having a molecular weight of at least 500 and no more than 1000 Daltons, a polydispersity of no more than 1.5 and an alpha molecule content of at least 50% may also be sulfurized to form anti-wear and anti-oxidant additive for lubricating oil. Suitable sulfur-containing reactants are elemental sulfur, hydrogen sulfide, sulfur dioxide, sodium sulfide hydrates are well known and are commercially available. Preferably elemental sulfur is used and which can be heated to the molten state to hasten the reaction kinetics and minimize the formation of mono- and polysulfides, dithiole derivatives including mercapto components which can be further decomposed into polyisobutyl-1,2-dithiole-4-cyclopentene-3-thione compositions. Further details may be found in U.S. Pat. No. 6,884,855 of Nelson et al., the disclosure of which is incorporated herein by reference.

Adducts of the invention also include Mannich reaction products prepared by further reacting alkylated hydroxyl aromatic compounds of the invention with an amine and an aldehyde. Particular procedures are described generally in U.S. Pat. No. 5,725,612 to Mailer et al. See, also, United States Patent Application Publication No. US 2007/0068070 of Jackson et al., which provides further description on procedures and Mannich products.

There is thus provided in Embodiment No. 1 of the invention, a PIB derivative suitable for use as a fuel additive or a lubricant additive prepared from a reactive low molecular weight polyisobutylene composition comprising at least 50 mol percent alpha vinylidene terminated polyisobutylene molecules, the composition having a polydispersity of no more than 1.5 and a number average molecular weight of at least 500 Daltons and no more than 1000 Daltons, wherein the derivative is selected from the group consisting of: alkyl hydroxyaromatic compounds; alkyl alkoxy aromatic compounds; polyisobutenylsuccinic anhydrides; polyisobutenylsuccinimides; PIB-amine compounds; sulfurized PIB compounds; and Mannich condensation products of an alkylated hydroxyaromatic compound.

Embodiment No. 2 of the invention is a derivative of a reactive low molecular weight polyisobutylene composition according to Embodiment No. 1, wherein the low molecular weight polyisobutylene composition comprises at least 60 mol percent alpha vinylidene terminated polyisobutylene molecules.

Embodiment No. 3 of the invention is a derivative of a reactive low molecular weight polyisobutylene composition according to Embodiment No. 1, wherein the low molecular weight polyisobutylene composition comprises at least 70 mol percent alpha vinylidene terminated polyisobutylene molecules.

Embodiment No. 4 of the invention is a derivative of a reactive low molecular weight polyisobutylene composition according to Embodiment No. 1, wherein the low molecular weight polyisobutylene composition comprises from 50 to 99 mol percent alpha vinylidene terminated polyisobutylene molecules.

Embodiment No. 5 of the invention is a derivative of a reactive low molecular weight polyisobutylene composition according to Embodiment No. 1, wherein no more than 10 mole % of the PIB molecules of the composition have tetra-substituted double bonds.

Embodiment No. 6 of the invention is a derivative of a reactive low molecular weight polyisobutylene composition according to Embodiment No. 1, wherein no more than 5 mole % of the PIB molecules of the composition have tetra-substituted double bonds.

Embodiment No. 7 of the invention is a derivative of a reactive low molecular weight polyisobutylene composition according to Embodiment No 1, wherein the composition has a polydispersity of no more than 1.4.

Embodiment No. 8 of the invention is a derivative of a reactive low molecular weight polyisobutylene composition according to Embodiment No. 1, wherein the composition has a polydispersity of no more than 1.3.

Embodiment No. 9 of the invention is a derivative of a reactive low molecular weight polyisobutylene composition according to Embodiment No. 1, wherein the composition has a polydispersity of from 1.2 to 1.5.

Embodiment No. 10 of the invention is a derivative of a reactive low molecular weight polyisobutylene composition according to Embodiment No. 1, wherein the polyisobutylene composition has a number average molecular weight of from 500 Daltons to 900 Daltons.

Embodiment No. 11 of the invention is a derivative of a reactive low molecular weight polyisobutylene composition according to Embodiment No. 1, wherein the polyisobutylene composition has a number average molecular weight of from 500 Daltons to 750 Daltons.

Embodiment No. 12 of the invention is a derivative of a reactive low molecular weight polyisobutylene composition according to Embodiment No. 1, wherein the polyisobutylene composition has a number average molecular weight of from 550 Daltons to 675 Daltons.

Embodiment No. 13 of the invention is a derivative of a reactive low molecular weight polyisobutylene composition according to Embodiment No. 1, wherein the composition further includes a polymerization-retarding agent.

Embodiment No. 14 of the invention is a derivative of a reactive low molecular weight polyisobutylene composition according to Embodiment No. 13, wherein the polymerization-retarding agent comprises a phenolic compound.

Embodiment No. 15 of the invention is a derivative of a reactive low molecular weight polyisobutylene composition according to Embodiment No. 13, wherein the polymerization-retarding agent is a hindered phenol.

Embodiment No. 16 of the invention is a derivative of a reactive low molecular weight polyisobutylene composition according to Embodiment No. 1, wherein the derivative is an alkyl phenol.

Embodiment No. 17 of the invention is a derivative of a reactive low molecular weight polyisobutylene composition according to Embodiment No. 1, wherein the derivative is a PIB-amine.

Embodiment No. 18 of the invention is a derivative of a reactive low molecular weight polyisobutylene composition according to Embodiment No. 1, wherein the derivative is a polyisobutenylsuccinic anhydride or a polyisobutenylsuccinimide.

Embodiment No. 19 of the invention is a derivative of a reactive low molecular weight polyisobutylene composition according to Embodiment No. 18, wherein the derivative is a polyisobutenylsuccinic anhydride.

Embodiment No. 20 of the invention is a derivative of a reactive low molecular weight polyisobutylene composition according to Embodiment No. 18, wherein the derivative is a polyisobutenylsuccinimide.

There is thus provided in Embodiment No. 21 of the invention, a liquid phase polymerization process to manufacture derivatives of polyisobutylene (PIB) having a number average molecular weight, Mn, of 1000 Daltons or less and at least 60 mol % percent alpha vinylidene terminated polyisobutylene molecules and derivatives thereof, said process comprising:

a) providing a feedstock comprising isobutylene;
b) providing a catalyst composition comprising a Friedel-Crafts catalyst and a complexing agent therefor;
c) providing a suitable chain transfer agent ("CTA");
d) providing a polymerization-retarding agent;
e) introducing said feedstock, said catalyst composition, said chain transfer agent and said polymerization-retarding agent into a reaction zone to form a reaction mixture;
f) intimately intermixing the reaction mixture in said reaction zone;
g) optionally adding a modifier;
h) maintaining the reaction mixture in its intimately intermixed condition to thereby cause the isobutylene therein to undergo polymerization to form polyisobutylene;
i) withdrawing a product stream comprising low molecular weight, highly reactive polyisobutylene from said reaction zone; and
j) derivatizing the low molecular weight, highly reactive polyisobutylene to form a product selected from the group consisting of: alkyl hydroxyaromatic compounds; alkyl alkoxy aromatic compounds; polyisobutenylsuccinic anhydrides; polyisobutenylsuccinimides; PIB-amine compounds; sulfurized PIB compounds; and Mannich condensation products of an alkylated hydroxyaromatic compound.

Embodiment No. 22 of the invention is a process of Embodiment No. 21, wherein said Friedel-Crafts catalyst is selected from the group consisting of $BF_3$, $AlCl_3$, $TiCl_4$, $BCl_3$, $SnCl_4$ and $FeCl_3$.

Embodiment No. 23 of the invention is a process of Embodiment No. 21, wherein said complexing agent is an alcohol.

Embodiment No. 24 of the invention is a process of Embodiment No. 23, wherein said alcohol is a primary alcohol.

Embodiment No. 25 of the invention is a process of Embodiment No. 23, wherein said alcohol is methanol.

Embodiment No. 26 of the invention is a process of Embodiment No. 21, wherein said modifier is present and is an alcohol.

Embodiment No. 27 of the invention is a process of Embodiment No. 26, wherein said modifier is methanol.

Embodiment No. 28 of the invention is a process of Embodiment No. 21, wherein said CTA is selected from the group consisting of 2,4,4-Trimethyl-1-pentene ("α-DIB"), 2.4.4.-Trimethyl-2-pentene ("β-DIB"), 2-ethyl-1-hexene, 2-methyl-1-pentene and mixtures thereof.

Embodiment No. 29 of the invention is a process of Embodiment No. 28, wherein said CTA is α-DIB.

Embodiment No. 30 of the invention is a process of Embodiment No. 28, wherein said CTA is β-DIB.

There is provided in Embodiment No. 31 of the invention, a method of preparing a derivative of a PIB composition suitable for use as a fuel or lubricant additive comprising:

(a) preparing a reactive low molecular weight polyisobutylene composition comprising at least 50 mol percent alpha vinylidene terminated polyisobutylene molecules, the composition having a polydispersity of no more than 1.5 and a number average molecular weight of at least 500 Daltons and no more than 1000 Daltons; and
(b) derivatizing said PIB composition to form a reaction product selected from the group consisting of: alkyl hydroxyaromatic compounds; alkyl alkoxy aromatic compounds; polyisobutenylsuccinic anhydrides; polyisobutenylsuccinimides; PIB-amine compounds; sulfurized PIB compounds; and Mannich condensation products of an alkylated hydroxyaromatic compound.

Embodiment No. 32 of the invention is a method according to Embodiment No. 31, wherein the reaction product is an alkylated hydroxyaromatic compound.

Embodiment No. 33 of the invention is a method according to Embodiment No. 32, wherein the alkyklated hydroxyaromatic compound is prepared using an alkylation catalyst.

Embodiment No. 34 of the invention is a method according to Embodiment No. 33, wherein the alkylation catalyst comprises $BF_3$.

Embodiment No. 35 of the invention is a method according to Embodiment No. 31, wherein the reaction product is an alkyl alkoxy aromatic compound.

Embodiment No. 36 of the invention is a method according to Embodiment No. 31, wherein the reaction product is a polyisobutenylsuccinic anhydride.

Embodiment No. 37 of the invention is a method according to Embodiment No. 31, wherein the reaction product is a polyisobutenylsuccinimide.

Embodiment No. 38 of the invention is a method according to Embodiment No. 31, wherein the reaction product is a PIB-amine compound.

Embodiment No. 39 of the invention is a method according to Embodiment No. 31, wherein the reaction product is a sulfurized PIB compound.

Embodiment No. 40 of the invention is a method according to Embodiment No. 31, wherein the reaction product is a Mannich condensation product of an alkylated hydroxyaromatic compound.

Embodiment No. 41 of the invention is a method according to Embodiment No. 31, wherein the derivative is an alkyl hydroxyaromatic compound or an alkyl alkoxy aromatic compound and the method has a selectivity to para-alkylated product of at least 75%.

Embodiment No. 42 of the invention is a method according to Embodiment No. 31, wherein the derivative is an alkyl hydroxyaromatic compound or an alkyl alkoxy aromatic compound and the method has a selectivity to para-alkylated product of at least 80%.

Embodiment No. 43 of the invention is a method according to Embodiment No. 31, wherein the derivative is an alkyl hydroxyaromatic compound or an alkyl alkoxy aromatic compound and the method has a selectivity to para-alkylated product of at least 85%.

Embodiment No. 44 of the invention is a method according to Embodiment No. 41, wherein the yield of para-alkylated product is at least 60%.

Embodiment No. 45 of the invention is a method according to Embodiment No. 41, wherein the yield of para-alkylated product is at least 70%.

While the invention has been described in detail, modifications within the spirit and scope of the invention will be readily apparent to those of skill in the art. Such modifications are also to be considered as part of the present invention. In view of the foregoing discussion, relevant knowledge in the art and references discussed above in connection with the Background of the Invention, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A PIB derivative suitable for use as a fuel additive or a lubricant additive prepared from a reactive low molecular weight polyisobutylene composition comprising at least 50 mol percent alpha vinylidene terminated polyisobutylene molecules, the composition having a number average molecular weight of no more than 1000 Daltons, wherein the polyisobutylene composition is prepared with a chain transfer agent having a molecular weight, Mn, lower than said polyisobutylene composition and the polyisobutylene composition is characterized in that the composition exhibits a low molecular weight relative maximum in its molecular weight distribution corresponding to the presence of said chain transfer agent and wherein the derivative is selected from the group consisting of: alkyl hydroxyaromatic compounds; alkyl alkoxy aromatic compounds; polyisobutenylsuccinic anhydrides; polyisobutenylsuccinimides; PIB-amine compounds; sulfurized PIB compounds; and Mannich condensation products of an alkylated hydroxyaromatic compound.

2. The derivative of a reactive low molecular weight polyisobutylene composition according to claim 1, wherein the low molecular weight polyisobutylene composition comprises at least 60 mol percent alpha vinylidene terminated polyisobutylene molecules.

3. The derivative of a reactive low molecular weight polyisobutylene composition according to claim 1, wherein the low molecular weight polyisobutylene composition comprises at least 70 mol percent alpha vinylidene terminated polyisobutylene molecules.

4. The derivative of a reactive low molecular weight polyisobutylene composition according to claim 1, wherein the low molecular weight polyisobutylene composition comprises from 50 to 99 mol percent alpha vinylidene terminated polyisobutylene molecules.

5. The derivative of a reactive low molecular weight polyisobutylene composition according to claim 1, wherein no more than 10 mole % of the PIB molecules of the composition have tetra-substituted double bonds.

6. The derivative of a reactive low molecular weight polyisobutylene composition according to claim 1, wherein no more than 5 mole % of the PIB molecules of the composition have tetra-substituted double bonds.

7. The derivative of a reactive low molecular weight polyisobutylene composition according to claim 1, wherein the composition has a polydispersity of no more than 1.4.

8. The derivative of a reactive low molecular weight polyisobutylene composition according to claim 1, wherein the composition has a polydispersity of no more than 1.3.

9. The derivative of a reactive low molecular weight polyisobutylene composition according to claim 1, wherein the composition has a polydispersity of from 1.2 to 1.5.

10. The derivative of a reactive low molecular weight polyisobutylene composition according to claim 1, wherein the polyisobutylene composition has a number average molecular weight of from 500 Daltons to 900 Daltons.

11. The derivative of a reactive low molecular weight polyisobutylene composition according to claim 1, wherein the polyisobutylene composition has a number average molecular weight of from 500 Daltons to 750 Daltons.

12. The derivative of a reactive low molecular weight polyisobutylene composition according to claim 1, wherein the polyisobutylene composition has a number average molecular weight of from 550 Daltons to 675 Daltons.

13. The derivative of a reactive low molecular weight polyisobutylene composition according to claim 1, wherein the composition further includes a polymerization-retarding agent.

14. The derivative of a reactive low molecular weight polyisobutylene composition according to claim 13, wherein the polymerization-retarding agent comprises a phenolic compound.

15. The derivative of a reactive low molecular weight polyisobutylene composition according to claim 13, wherein the polymerization-retarding agent is a hindered phenol.

16. The derivative of a reactive low molecular weight polyisobutylene composition according to claim 1, wherein the derivative is an alkyl phenol.

17. The derivative of a reactive low molecular weight polyisobutylene composition according to claim 1, wherein the derivative is a PIB-amine.

18. The derivative of a reactive low molecular weight polyisobutylene composition according to claim 1, wherein the derivative is a polyisobutenylsuccinic anhydride or a polyisobutenylsuccinimide.

19. The derivative of a reactive low molecular weight polyisobutylene composition according to claim 18, wherein the derivative is a polyisobutenylsuccinic anhydride.

20. The derivative of a reactive low molecular weight polyisobutylene composition according to claim 18, wherein the derivative is a polyisobutenylsuccinimide.

21. The derivative of a reactive low molecular weight polyisobutylene composition according to claim 1, wherein the chain transfer agent is an olefinic chain transfer agent.

22. The derivative of a reactive low molecular weight polyisobutylene composition according to claim 1, wherein the chain transfer agent is present in the polyisobutylene composition in an amount of from 2 weight percent to 20 weight percent.

23. The derivative of a reactive low molecular weight polyisobutylene composition according to claim 1, wherein the chain transfer agent is present in the polyisobutylene composition in an amount of from 4 weight percent to 10 weight percent.

24. The derivative of a reactive low molecular weight polyisobutylene composition according to claim 1, wherein the chain transfer agent has a molecular weight of from 100 to 150 Daltons.

25. The derivative of a reactive low molecular weight polyisobutylene composition according to claim 1, wherein the chain transfer agent is selected from α-DIB and β-DIB:

(α-DIB)

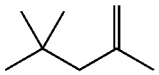

2,4,4-trimethylpent-1-ene (β-DIB)

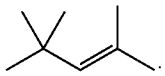

2,4,4-trimethylpent-2-ene

26. A PIB derivative suitable for use as a fuel additive or a lubricant additive prepared from a reactive low molecular weight polyisobutylene composition having a number average molecular weight of no more than 750 Daltons, and the following isomer content on a molar basis: 60-90% Alpha isomer content and 30-10% Beta isomer content, wherein the derivative is selected from the group consisting of: alkyl hydroxyaromatic compounds; alkyl alkoxy aromatic compounds; polyisobutenylsuccinic anhydrides; polyisobutenylsuccinimides; PIB-amine compounds; sulfurized PIB compounds; and Mannich condensation products of an alkylated hydroxyaromatic compound.

27. The PIB derivative according to claim 26, wherein the reactive low molecular weight polyisobutylene composition has no more than 10 mole % of the PIB molecules of the composition with tetra-substituted double bonds.

28. The PIB derivative according to claim 26, wherein the reactive low molecular weight polyisobutylene composition has no more than 5 mole % of the PIB molecules of the composition with tetra-substituted double bonds.

29. The PIB derivative according to claim 28, wherein the reactive low molecular weight polyisobutylene composition also contains 2-5% of Trisubstituted isomer having the structure:

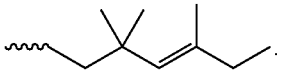

30. The derivative of a reactive low molecular weight polyisobutylene composition according to claim 1, wherein the polyisobutylene composition has a number average molecular weight of at least 500 Daltons.

31. The derivative of a reactive low molecular weight polyisobutylene composition according to claim 1, wherein the polyisobutylene composition has a polydispersity of no more than 1.5.

* * * * *